US011209158B2

(12) United States Patent
Lankinen et al.

(10) Patent No.: US 11,209,158 B2
(45) Date of Patent: Dec. 28, 2021

(54) BOILER CONSTRUCTION HAVING A BOILER PRESSURE BODY SUPPORT SYSTEM

(71) Applicant: SUMITOMO SHI FW ENERGIA OY, Espoo (FI)

(72) Inventors: Pentti Lankinen, Varkaus (FI); Heikki Holopainen, Pieksämäki (FI); Jussi Pollari, Kuopio (FI); Martyna Poreba-Sebastjan, Ruda Śląska (PL); Slawomir Solipiwko, Czekanka (PL)

(73) Assignee: Sumitomo SHI FW Energia Oy, Espoo (FI)

( * ) Notice: Subject to any disclaimer, the term of this patent is extended or adjusted under 35 U.S.C. 154(b) by 0 days.

(21) Appl. No.: 16/650,079

(22) PCT Filed: Oct. 16, 2017

(86) PCT No.: PCT/EP2017/076329
§ 371 (c)(1),
(2) Date: Mar. 24, 2020

(87) PCT Pub. No.: WO2019/076427
PCT Pub. Date: Apr. 25, 2019

(65) Prior Publication Data

US 2020/0292164 A1 Sep. 17, 2020

(51) Int. Cl.
*F22B 37/24* (2006.01)
*F22B 37/20* (2006.01)
(Continued)

(52) U.S. Cl.
CPC ..... *F22B 37/244* (2013.01); *F22B 37/208* (2013.01); *F22B 33/00* (2013.01);
(Continued)

(58) Field of Classification Search
None
See application file for complete search history.

(56) References Cited

U.S. PATENT DOCUMENTS 2,583,599 A 1/1952 Schoessow
2,700,375 A * 1/1955 Godshalk ..... F22B 37/201 122/6 A
(Continued)

FOREIGN PATENT DOCUMENTS

CN 202719590 U 2/2013
CN 103216809 A 7/2013
(Continued)

OTHER PUBLICATIONS

Office Action and Search Report dated Aug. 27, 2020, issued in corresponding Russian Patent Application No. 2020115626.
(Continued)

*Primary Examiner* — Gregory A Wilson
(74) *Attorney, Agent, or Firm* — Venable LLP

(57) ABSTRACT

A boiler construction includes a boiler pressure body having a bottom and a roof at a height H from the bottom and at least four planar watertube walls forming a polygonal horizontal cross section with at least four corner sections, and a rigid support steel structure, the boiler pressure body being supported to the rigid support steel structure at a height between the bottom and roof. A vertical corner column is attached exteriorly to at least four of the at least four corner sections at a height region between the bottom and roof, and the supporting of the boiler pressure body is provided by supporting each of the vertical corner columns to the rigid support steel structure at a height from 0.1 H to 0.9 H from the bottom so as to balance vertical loads of the boiler pressure body.

15 Claims, 6 Drawing Sheets

(51) Int. Cl.
*F22B 33/00* (2006.01)
*F22B 37/14* (2006.01)

(52) U.S. Cl.
CPC ..... *F22B 37/141* (2013.01); *F22B 37/201* (2013.01); *F22B 37/242* (2013.01)

(56) References Cited

U.S. PATENT DOCUMENTS

| | | | | | |
|---|---|---|---|---|---|
| 2,856,906 | A | | 10/1958 | Armacost | |
| 3,274,977 | A | * | 9/1966 | Rickard | F22B 37/208 122/240.1 |
| 3,811,415 | A | | 5/1974 | Lawrence et al. | |
| 3,814,063 | A | * | 6/1974 | Bijmholt | F22B 37/104 122/6 A |
| 3,861,360 | A | * | 1/1975 | Shank, Jr. | F22B 37/208 122/6 A |
| 4,381,735 | A | * | 5/1983 | Brunner | F22B 37/208 122/510 |
| 4,428,329 | A | * | 1/1984 | Rees | F22B 37/244 122/235.12 |
| 5,278,880 | A | * | 1/1994 | Baker | G21C 13/02 376/285 |
| 5,557,901 | A | * | 9/1996 | Hoosic | F22B 37/208 52/506.03 |
| 5,865,149 | A | * | 2/1999 | Patel | F22B 37/208 122/510 |
| 6,058,893 | A | * | 5/2000 | Patel | F22B 37/208 122/493 |
| 6,588,104 | B2 | | 7/2003 | Heidrich | |
| 8,333,170 | B2 | * | 12/2012 | Zaman | F22B 37/208 122/512 |
| 9,964,301 | B2 | | 5/2018 | Lankinen et al. | |
| 2008/0276885 | A1 | * | 11/2008 | Seppanen | F22B 37/24 122/510 |
| 2015/0024105 | A1 | | 1/2015 | Perlman | |
| 2015/0241054 | A1 | | 8/2015 | Zaman | |

FOREIGN PATENT DOCUMENTS

| | | | | | |
|---|---|---|---|---|---|
| CN | 203162915 | U | | 8/2013 | |
| DE | 1426718 | A1 | | 1/1970 | |
| DE | 1955982 | A1 | | 12/1970 | |
| DE | 4017253 | A1 | | 12/1991 | |
| DE | 19821587 | A1 | | 11/1999 | |
| DE | 10014758 | C2 | | 10/2003 | |
| EP | 0073851 | A1 | | 3/1983 | |
| EP | 1998111 | A2 | | 12/2008 | |
| FR | 2597576 | B1 | | 6/1989 | |
| GB | 843085 | A | * | 8/1960 | F22B 37/208 |
| GB | 1069545 | A | | 5/1967 | |
| GB | 1577049 | A | * | 10/1980 | F22B 37/24 |
| JP | H05-264006 | A | | 10/1993 | |
| JP | H10-267207 | A | | 10/1998 | |
| JP | 2001-173947 | A | | 6/2001 | |
| JP | 2016-521838 | A | | 7/2016 | |
| KR | 10-2015-0065833 | A | | 6/2015 | |
| KR | 10-2016-0008643 | A | | 1/2016 | |
| RU | 2122678 | C1 | | 11/1998 | |
| RU | 2229056 | C2 | | 5/2004 | |
| WO | WO-2019215383 | A1 | * | 11/2019 | F22B 37/143 |

OTHER PUBLICATIONS

Notification of and International Search Report and Written Opinion dated Jul. 2, 2018, in corresponding International Patent Application No. PCT/EP2017/076329.
Notification of and International Preliminary Reporton Patentability dated Oct. 14, 2019, in corresponding International Patent Application No. PCT/EP2017/076329.
Office Action dated Apr. 30, 2021, issued in corresponding Japanese Patent Application No. 2020-514718.
Office Action dated Mar. 10, 2021, issued in corresponding Indian Patent Application No. 202047019847.
Office Action dated Jul. 2, 2021, issued in corresponding Chinese Patent Application No. 201780095801.2.
Office Action dated Jul. 19, 2021, issued in corresponding Korean Patent Application No. 10-2020-7012670.
Office Action dated Aug. 30, 2021, issued in corresponding Indonesian Patent Application No. P00202003425.

* cited by examiner

BOILER CONSTRUCTION HAVING A BOILER PRESSURE BODY SUPPORT SYSTEM

CLAIM OF PRIORITY

This application is a U.S. national stage application of International Patent Application No. PCT/EP2017/076329, filed Oct. 16, 2017, now published as International Publication No. WO 2019/076427 A1 on Apr. 25, 2019.

BACKGROUND OF THE INVENTION

Field of the Invention

The present invention relates to a boiler construction. More particularly, the invention relates to a boiler construction comprising a boiler pressure body having a bottom and a roof at a height H from the bottom and at least four planar watertube walls forming a polygonal horizontal cross section with at least four corner sections, and a rigid support steel structure, the boiler pressure body being supported to the rigid support steel structure at a height between the bottom and the roof. The boiler pressure body is advantageously a furnace, but it can alternatively be another structural part of the boiler formed of planar watertube walls, such as a particle separator, a convection cage, or an empty pass.

Description of Related Art

Relatively large boilers are conventionally arranged top-supported, i.e., they are supported so that the furnace, or, more generally, the boiler pressure body, of the boiler is arranged to hang from a conventional rigid support steel structure extending around and above the boiler pressure body. Relatively small boilers are conventionally arranged bottom-supported, wherein a vertical load of the boiler pressure body is balanced solely by a rigid support steel structure arranged below the boiler. The main difference between top-supported and bottom-supported constructions is that when the temperature of the boiler increases, thermal expansion of a top-supported boiler takes place mainly downwards, whereas in a bottom-supported boiler thermal expansion takes place mainly upwards. Bottom-supported boilers are, in the case of relatively small boilers, generally simpler and economically more advantageous than top-supported boilers, because they do not require a separate rigid support steel structure extending around and above the boiler pressure body. A disadvantage of bottom-supported construction is that the walls of the boiler pressure body have to be strong enough to carry the vertical compression load of the pressure body.

A third alternative is to support the boiler pressure body to a rigid support steel structure at its middle section. Thereby, the lower portion of the boiler pressure body, below the middle section, is top-supported, and the upper portion of the boiler pressure body, above the middle section, is bottom supported. Middle-supported construction is advantageous for some applications since it reduces the size of the support steel structure from that needed around the pressure body of a top-supported boiler. Simultaneously, such a middle-supported construction eliminates the need for very strong walls of the boiler pressure body as in large bottom-supported boilers. Different middle-supported boiler constructions are shown, for example, in U.S. Pat. Nos. 2,583,599, 2,856,906, European patent publication application EP 0073851 A1, and U.S. Patent Application Publication No. 2015/0241054.

U.S. Pat. No. 4,428,329 discloses a middle supported boiler construction with a support steel structure comprising multiple cantilever arms at an intermediate height of the boiler. In order to absorb horizontal thermal expansion, the tubewalls of the furnace and back pass of the boiler are hanging from multiple levers flexibly connected to the cantilever arms by a large number of vertical links attached to an inwards bent section of the tubewall. Patent documents EP 1 998 111 A2, DE 19 55 982 A1, and DE 198 21 587 A1 disclose conventionally supported boilers with constructions for lateral supporting the boiler body, and document DE 19 55 982 discloses a middle supported boiler having vertical columns and springs or counterweights to obtain additional partial weight relief.

A problem in designing middle-supported boilers is to find a simple and an advantageous way to attach the middle section of the boiler pressure body to a rigid support steel structure around the furnace and simultaneously take into account the effects of thermal expansion.

An object of the present invention is to provide an advantageous construction for a middle-supported boiler.

SUMMARY OF THE INVENTION

According to one aspect, the present invention provides a boiler construction comprising a boiler pressure body having a bottom and a roof at a height H from the bottom and at least four planar watertube walls forming a polygonal horizontal cross section with at least four corner sections, and a rigid support steel structure, the boiler pressure body being supported to the rigid support steel structure at a height between the bottom and the roof, wherein a vertical corner column is attached exteriorly to at least four of the at least four corner sections at a height region between the bottom and the roof, and the supporting of the boiler pressure body is provided by supporting each of the vertical corner columns to the rigid support steel structure at a height from 0.1 H to 0.9 H from the bottom, so as to balance vertical loads of the boiler pressure body.

The term "boiler pressure body" refers herein generally to a structural part of a steam generation plant formed of planar watertube walls, i.e., of generally vertical tubes conveying high pressure water or steam and being connected together in a conventional way by fins welded between the tubes. According to an embodiment of the present invention, the boiler pressure body is the furnace of a fluidized bed boiler, but the boiler pressure body can alternatively be another type of pressure body, such as a furnace, a convection cage, or an empty pass of any type of a steam generator, such as, for example, a bubbling bed boiler or a pulverized coal (PC) boiler. When the description below refers to a furnace, it should be understood that the pressure body may alternatively be another boiler pressure body, whenever suitable. The boiler pressure body usually has a rectangular horizontal cross section with four corner sections formed by the watertube walls, but generally, the boiler pressure body may have a polygonal horizontal cross section with even more than four corner sections.

A main feature of the present invention is that the boiler pressure body is middle-supported, i.e., that vertical loads, such as gravitational forces and seismic forces, affecting the boiler pressure body are balanced to the rigid support steel structure at an intermediate height, between the bottom and the roof, of the boiler pressure body. More particularly, when the height of the boiler pressure body from its bottom to the roof is H, the boiler pressure body is preferably supported to the rigid support steel structure at a height from 0.1 H to 0.9 H from the bottom, more preferably, from 0.3 H to 0.7 H from the bottom, and, even more preferably, at a height from 0.4 H to 0.6 H from the bottom. By the above mentioned height of supporting is hereafter meant the level of the boiler pressure body that does not move in the vertical direction due to thermal expansion of the boiler pressure body. According to another main feature of the present invention, supporting of the boiler pressure body, or, more precisely, balancing of vertical loads of the boiler pressure body, is provided through vertical corner columns attached exteriorly, or outside, the corner sections formed by the watertube walls of the boiler pressure body.

The rigid support steel structure advantageously comprises multiple vertical main support columns supported to the ground or the foundation of the boiler, and the boiler pressure body is supported to multiple horizontal main support beams attached to the vertical main support columns. The horizontal main support beams are preferably attached to the vertical main support columns at a height from 0.1 H to 0.9 H, more preferably, at a height from 0.3 H to 0.7 H, and, even more preferably, at a height from 0.4 H to 0.6 H, from the bottom. Thus, the horizontal main support beams according to the present invention are at a considerably lower level than in a conventional top-supported boiler, where they are typically at a level of about 1.1 H from the bottom.

In the case of a conventional boiler pressure body having a rectangular cross section with four corner sections, vertical corner columns are naturally attached to all of the four corner sections. Even in the case of a boiler pressure body having a polygonal cross section with more than four corner sections, vertical corner columns are advantageously attached to suitably selected four corner sections. Vertical corner columns can alternatively be attached to more than four corner sections, such as six or eight corner sections, of a boiler pressure body with multiple corner sections, such as a polygonal particle separator.

It may, in some embodiments of the present invention, be possible to supplement the above described middle-supporting of the boiler pressure body by flexible auxiliary top-supporting or bottom-supporting, but, in any case, according to the present invention, most of the vertical loads of the boiler pressure body are balanced by the middle-support. According to a preferred embodiment of the present invention, vertical loads of the boiler pressure body are balanced solely by the vertical corner columns attached to the corner sections. The expression that a boiler pressure body is supported solely through its corner sections does not mean that there are no connections to the surrounding structures outside of the corner sections, but that such other connections, such as devices for conveying flue gas from the furnace or water to the water tubes, or devices for feeding air and fuel to the furnace, do not provide any essential balancing of vertical loads of the boiler pressure body.

Supporting the boiler pressure body solely through the vertical corner columns is possible because of a relatively high shear force capacity provided by a conventional watertube wall. Watertube walls of a boiler pressure body can, in practice, be supported solely through vertical corner columns attached to their corner sections up to a width of about 20 meters, or even higher, whereby, they are suitable to support, for example, the furnace of a circulating fluidized bed boiler up to a capacity of 50 to 100 MWe, or even higher.

Due to the ratio of height and width of a conventional boiler pressure body, thermal expansion of the planar water tube walls of the boiler pressure body usually takes place mainly in the vertical direction. However, thermal expansion generally also takes place, although usually to a smaller amount, in the horizontal direction. As mentioned above, as the boiler pressure body is supported at its middle section, thermal expansion in the vertical direction takes place above the middle section upwards and below the middle section downwards. Supporting the boiler pressure body solely through the corner columns to the rigid support steel structure at a height from 0.1 H to 0.9 H from the bottom provides an advantageous construction that renders possible simple and effective absorbing of horizontal thermal expansion.

In order to allow horizontal thermal expansion, the connection between the vertical corner columns and the rigid support steel structure has to be adaptive in all, or at least in all but one, horizontal directions. Such an adaptive connection can be provided by arranging the supporting of the boiler pressure body through the vertical corner columns either by hanging from above or by supporting from below. In the middle from above supported construction, the vertical corner columns are arranged hanging from the rigid support steel structure, or the horizontal main supporting beams of the rigid support steel structure. In the middle from below supported construction, the vertical corner columns are supported to horizontal main support beams by suitable sliding connections.

More particularly, the vertical corner columns are in the middle from above supported arrangement advantageously supported to the horizontal main support beams by at least one hanger rod attached to the vertical corner column by at least one support lug. Each vertical corner column is usually, in practice, supported to the horizontal main support beams by at least two hanger rods. Such hanger rods enable absorbing of horizontal thermal expansion by slight tilting of the hanger rods, so as to allow relatively small horizontal movements of the corner section. According to an especially preferable embodiment of the present invention, each of the vertical corner columns is hanging from at least one horizontal auxiliary support beam supported by two adjacent beams of the horizontal main support beams.

Correspondingly, the vertical corner columns are in the middle from below supported arrangement advantageously supported to the rigid support steel structure by arranging suitable sliding connection, such as sliding bearings, on the horizontal main supporting beams of the rigid support steel structure. The sliding connection enables absorbing of horizontal thermal expansion by allowing relatively small horizontal movements of the corner section. According to a preferred embodiment of the present invention, the sliding connection comprises a steel base plate attached to the vertical corner column by vertically extending ribs, or support lugs. The base plate is then advantageously supported by a steel sliding surface or sliding bearings to two adjacent, perpendicular to each other arranged horizontal main support beams.

The vertical corner columns are to be attached to the respective corner section in a region of at least a sufficient height to provide the required strength. In some applications, the height is preferably at least 5%, even more preferably at least 15%, of the height of the boiler pressure body. It is also possible that the vertical corner columns are attached to the respective corner sections in a clearly greater height region, such as at least 30%, or even throughout most or all of the height of the boiler pressure body. The vertical corner columns are advantageously attached to the corner section by at least one continuous metal strip so as to provide, in the vertical direction, a rigid joint. The attaching to the corner section is advantageously made by continuous welding to at least one corner tube or a corner fin between outermost water tubes of the water tube walls forming the corner section.

In order to avoid thermal stress between the vertical corner columns and the boiler pressure body, the corner columns are advantageously maintained at least nearly at the same temperature as the boiler pressure body. Thus, the metal strip connecting the corner column to the corner section is advantageously dimensioned so that it provides, in addition to the desired rigidity, also a good thermal contact between the corner section and the vertical column. The vertical corner columns are also usually arranged inside a common thermal insulation with the boiler pressure body.

According to a preferred embodiment of the present invention, at least one, or preferably each, of the vertical columns is a boiler pipe. The boiler pipes are advantageously downcomer pipes of the boiler, but, in some applications, they could also be, for example, steam pipes. By using downcomer pipes as the vertical columns, the need for special supporting of the downcomer pipes is minimized. Because the water in the downcomer pipes is nearly at the same temperature as the water in the water wall tubes, there is not any significant thermal stress between the water tube walls and the downcomer pipes attached to the water tube walls.

According to another preferred embodiment of the present invention, which is especially applicable when downcomer pipes or other suitable boiler pipes are not available, the multiple vertical corner columns are not boiler pipes, or at least one of the multiple vertical columns is not a boiler pipe. Such vertical columns can be, for example, separate hollow vertical beams with a square cross section, or hollow beams of any shape, or even solid bars. Such separate vertical beams, which are dedicated to the use as the vertical columns, have the advantage that their sizes can be more freely selected. When using such separate beams as the vertical columns, minimizing temperature difference between the water tube walls and the vertical columns has to be ensured by using especially good thermal conductivity providing metal strips between the water tube walls and the vertical columns. In order to minimize the temperature difference, each of the vertical columns, no matter of being, for example, a boiler pipe or a hollow vertical beam, is preferably arranged inside a common thermal insulation with the boiler pressure body.

The present invention renders possible an especially straight forward design of the boiler, clearly faster erection of the boiler than by using conventional methods, and, in many cases, a remarkable reduction in the quantities of the required steel structures.

The above brief description, as well as further objects, features, and advantages of the present invention will be more fully appreciated by reference to the following detailed description of the currently preferred, but nonetheless illustrative, embodiments in accordance with the present invention, when taken in conjunction with the accompanying drawings.

DETAILED DESCRIPTION OF THE INVENTION

Figure 1:
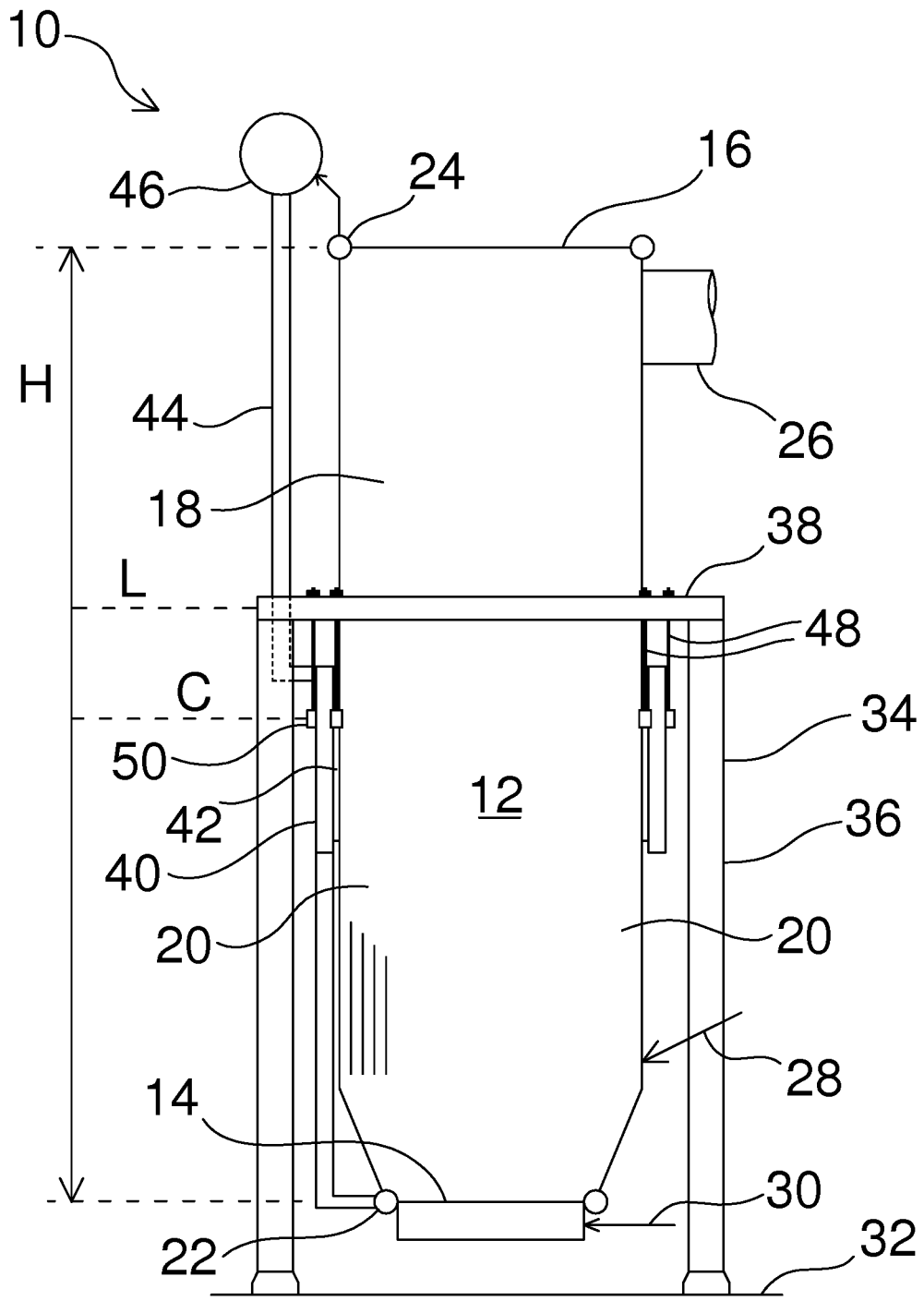
FIG. 1 schematically illustrates a side view of a boiler according to a first preferred embodiment of the present invention.

FIG. 1 schematically illustrates a side view of a fluidized bed boiler construction 10, representing an embodiment of the present invention. The fluidized bed boiler construction 10 comprises a furnace 12 having a bottom 14 and a roof 16 at a height H from the bottom 14, and four planar watertube walls 18, only one of which is seen in FIG. 1. The watertube walls 18 are of a conventional type, consisting of vertical water tubes connected together by fins. The watertube walls 18 form a rectangular cross section with four corner sections 20, two of which are seen in FIG. 1. The furnace 12 comprises conventional equipment, such as inlet and outlet headers 22, 24, a flue gas duct 26, and a feed for feeding fuel 28 and primary air 30 to the furnace 12. Because such equipment is not relevant for understanding the present invention, they are not described here in detail.

The furnace 12 is supported to the ground 32 via a rigid support steel structure 34 arranged around the boiler construction 10. The support steel structure 34 comprises multiple vertical main support columns 36, in practice, at least four vertical main support columns 36, and multiple horizontal main support beams 38 attached between the vertical main support columns 36. As seen in FIG. 1, the horizontal main support beams 38 are at a level L that is clearly below the roof 16 of the furnace, for example, from 0.3 H to 0.7 H from the bottom 14.

According to the present invention, a vertical corner column 40 is attached, advantageously, by a continuous metal strip 42, to a vertical middle portion of each of the corner sections 20. The attachment of the vertical corner columns 40 to the respective corner sections 20 has to be strong enough to enable carrying the weight of the furnace 12. The vertical corner columns 40 are thus preferably attached to the respective corners section 20 in a height region of at least 5%, even more preferably, at least 15%, of the height H of the boiler pressure body. The vertical corner columns 40 may be portions of downcomers 44, circulating boiler water from a steam drum 46 to an inlet header 22, or other columns suitable for supporting the furnace 12.

According to the embodiment shown in FIG. 1, the furnace 12 is supported to the support steel structure 34 by hanger rods 48. The upper edges of the hanger rods 48 are attached to the horizontal main support beams 38, and the lower edges of the hanger rods 48 are attached to the vertical corner columns 40 by lugs 50 attached to two sides of the vertical corner columns 40. Thus, the vertical corner columns 40 are supported to the hanger rods 48, and by them to the support steel structure 34 at the level C of the lugs 50, which level C is lower than the level L of the horizontal main support beams 38.

When the furnace 12 heats up from ambient temperature to the operating temperature, thermal expansion lengthens the height and width of the furnace 12. Assuming that the hanger rods 48 stay at the ambient temperature, but the vertical corner columns 40 follow the temperature of the furnace 12, the middle portion of the furnace 12, at the level C of the lugs 50, remains at its original level. The upper portion of the furnace 12, upwards from the level C, expands upwards, and the lower portion of the furnace 12, downwards from the level C, expands downwards. The hanger rods 48 may, in practice, also be partially hot, which has to be taken into account when considering exact vertical movements of the furnace 12. In addition to the vertical expansion, the furnace 12 also experiences expansion in the horizontal direction. Horizontal movement due to horizontal expansion is made possible by tilting of the lower ends of the hanger rods 48 outwards. In order to avoid too large tilting angles, the hanger rods 48 have to have a sufficient length, such as at least about three meters. Longer hanger rods 48 absorb thermal expansion by less tilting, but they have the disadvantage of possibly increasing the height of the rigid steel construction needed for supporting the boiler pressure body at a certain height.

FIGS. 1-6 show views and details of different embodiments of the present invention. The same reference numbers are generally used for the same or similar elements in the different embodiments in each of FIGS. 1-6. It is also to be understood that FIGS. 1-6 show only exemplary embodiments of the present invention, and features shown in the different embodiments can be changed to corresponding features shown in other embodiments, or to those based on the general teachings of the present description, whenever it is technically possible.

Figure 2A:
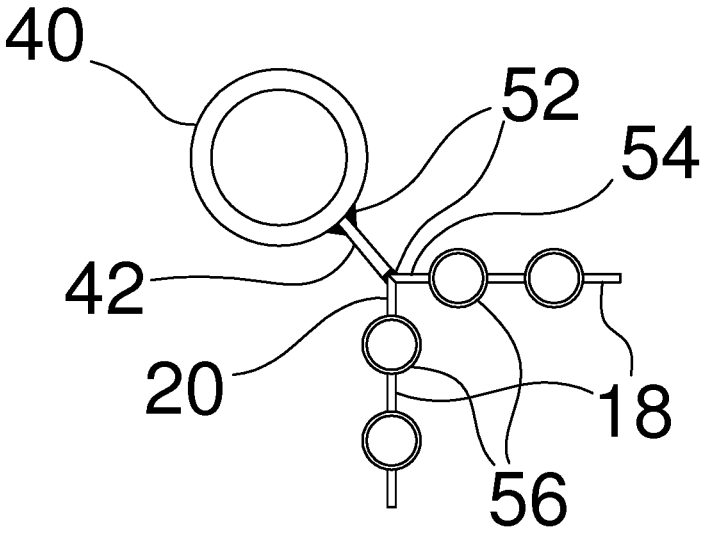
FIGS. 2*a* and 2*b* schematically illustrate two embodiments of a detail of a boiler according to the present invention.
Figure 2B:
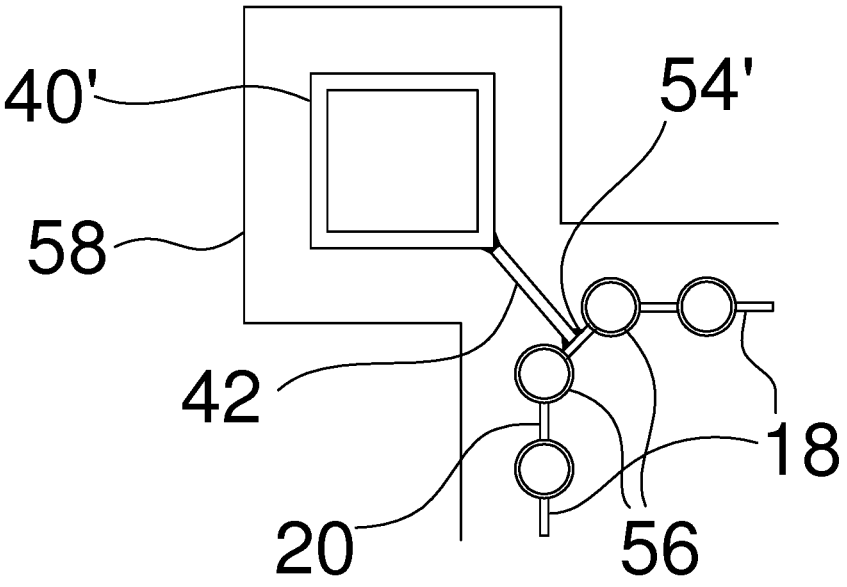

FIGS. 2*a* and 2*b* schematically show in more detail a horizontal cross section of two examples of attaching a vertical corner column 40, 40' to the corner section 20 of two water tube walls 18 by a strong vertically extending metal strip 42. In FIG. 2*a*, the vertical corner column 40 is a thick walled boiler pipe, preferably, a downcomer pipe of the boiler, whereas, in FIG. 2*b* the vertical corner column 40' is a hollow vertical beam with a square cross sectional shape. In practice, the vertical corner column 40, 40' may also have any other suitable cross-sectional shape. The metal strip 42 is preferably attached by continuous welding 52 to the vertical corner column 40, 40' and to a corner fin 54, 54' between the outermost water tubes 56 of the watertube walls 18 forming the corner section 20. FIG. 2*a* shows, as an example, a corner-like corner fin 54, whereas, FIG. 2*b* shows, as another example, a beveled corner fin 54'.

The temperature difference between the corner section 20 and the vertical corner column 40 has to be relatively small in any operating condition in order to avoid unnecessary thermal fatigue. Therefore, the metal strip 42 is advantageously dimensioned so as to provide, in addition to the required strength, also sufficient thermal conductivity between the corner section 20 and the respective vertical corner column 40, 40'. The vertical corner column 40, 40' and the watertube walls 18 of the furnace are advantageously also covered by a common insulator layer 58, as schematically shown in FIG. 2*b*.

Figure 3A:
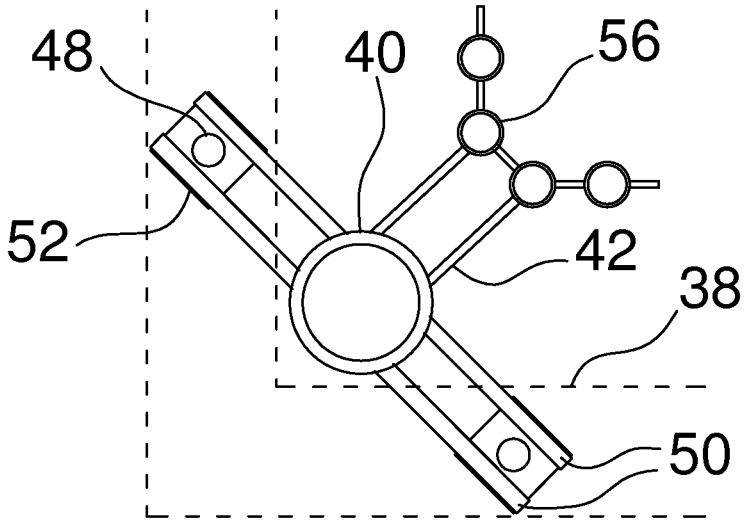
FIGS. 3*a* and 3*b* schematically illustrate other details of a boiler according to an embodiment of the present invention.
Figure 3B:
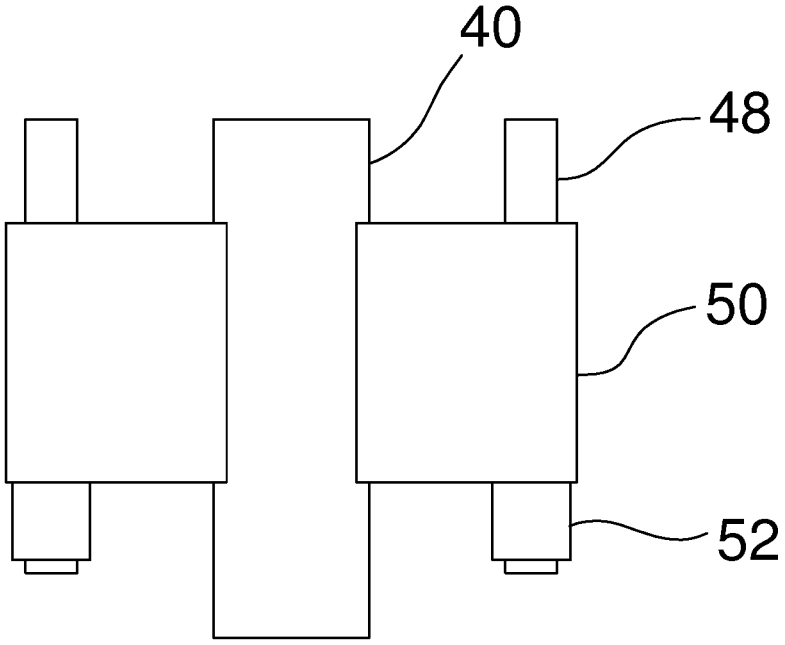

FIGS. 3*a* and 3*b* schematically show in horizontal cross section and in a side view, respectively, an exemplary way of hanging a vertical corner column 40 from horizontal main support beams 38 of a support steel structure 34. In this embodiment, a pair of support lugs 50 is attached to each of two opposite sides of the vertical corner column 40, and a hanger rod 48 is attached by a nut 52 at the outer end of each of the pairs of support lugs 50. Upper ends of the hanger rods 48 are locked by a suitable means to the horizontal main support beams 38, as is seen in FIG. 1.

In the example shown in FIG. 3*a*, the support lugs 50 extend horizontally far enough to enable connecting the hanger rods 48 directly to horizontal main support beams 38 above the end portions of the support lugs 50. In practice, it may be useful to fix the upper ends of the hanger rods 48 to suitable auxiliary horizontal beams, not shown in FIG. 3*a*, arranged, for example, above two opposite sides of the corner column 40 and supported to the horizontal main support beams 38. FIG. 3*a* also shows an alternative way of attaching the corner column 40 to the corner section 20. Here, the corner column 40 is attached to the corner section 20 by two metal strips 42 connected to the two outermost water tubes 56. Using two metal strips, or even more than two metal strips, naturally further strengthens the attachment, and also improves the thermal connection of the corner column 40 to the furnace 12.

Figure 4:
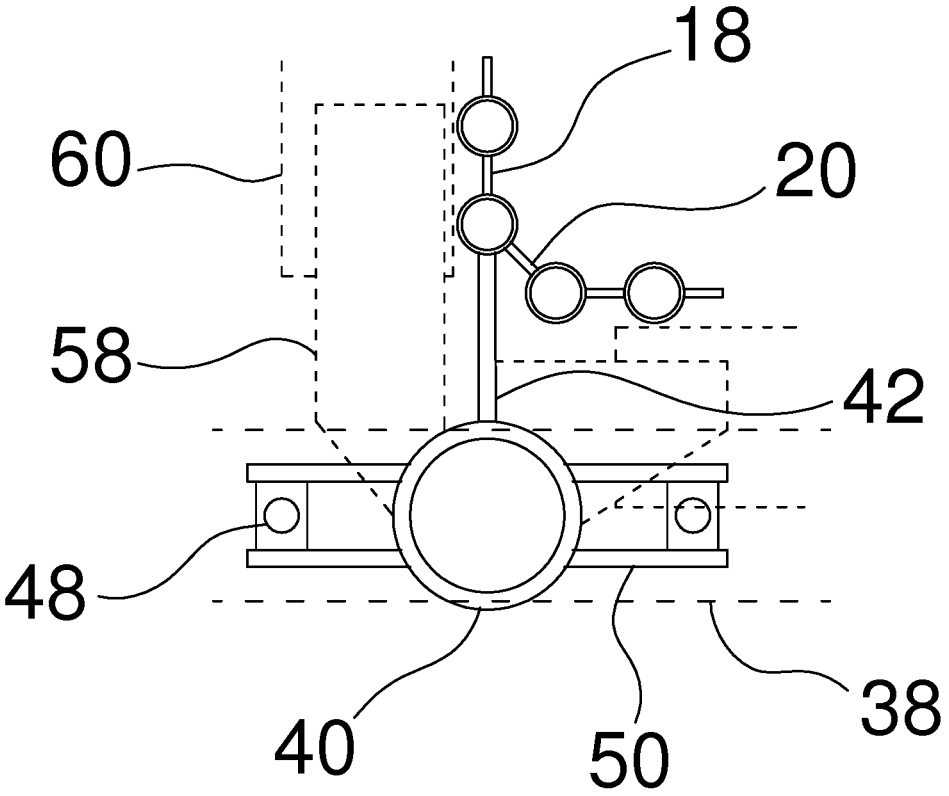
FIG. 4 schematically illustrates a detail of a boiler according to a further embodiment of the present invention.

FIG. 4 schematically shows a detail of another exemplary embodiment of the present invention in which a vertical corner column 40 is attached to the corner section 20 of two watertube walls 18 of the furnace 12 by a vertically extending metal strip 42 that is parallel to the extension of a water tube wall 18, instead of being at a forty-five degree angle, as shown in FIGS. 2*a*, 2*b*, and 3*a*. The orientation of the metal strip 42, which may, as is clear to a person skilled in the art, have still other possibilities than those described above, affects the most suitable orientation of the lugs 50, and is also a most suitable way to attach the hanger rods 48 to the horizontal main support beams 38. Especially when the vertical corner column 40 is a portion of a downcomer pipe of the boiler construction 10, there may be a need to arrange the hanging of the vertical corner column 40 from the horizontal main support beams 38, for example, by using auxiliary support beams, to avoid making extra bends to the downcomer pipe in order to go round the horizontal support beams 38.

FIG. 4 also shows that the vertical corner column 40 may advantageously be connected by suitable linking pieces 58 to the buckstays 60 of the furnace 12. As has been explained above, the main function of the vertical corner columns 40 is to enable simple and efficient supporting of the furnace 12 at its middle section by the corners. The additional strength provided by the vertical corner columns 40 to the furnace 12 enclosure also provides the additional advantage of reducing the number of buckstays needed to avoid the risk of bulging of the furnace enclosure.

Figure 5:
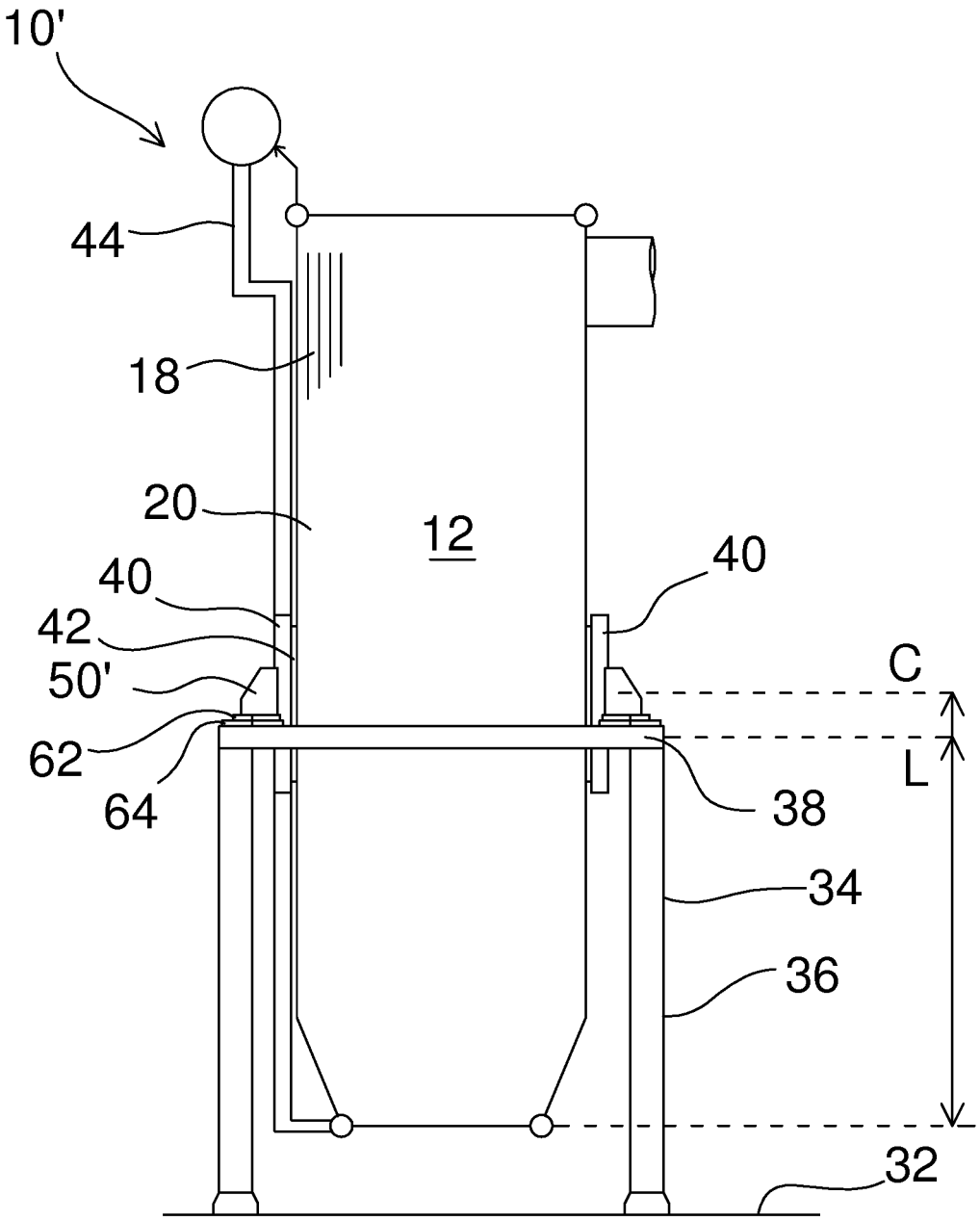
FIG. 5 schematically illustrates a side view of a boiler according to a preferred embodiment of the present invention.

FIG. 5 schematically shows a side view of a fluidized bed boiler construction 10', representing another embodiment of the present invention. The construction of FIG. 5 differs from that of FIG. 1 mainly in that the vertical corner columns 40 are not hanging from the horizontal main support beams 38, but the vertical corner columns 40 are supported from below by vertically extending support lugs 50' arranged on the main support beams 38. Therefore, the vertical corner columns 40 are supported to the support steel structure 34 at the level C of the support lugs 50', which level C is higher than the level L of the horizontal main support beams 38. In order to enable movements relating to horizontal thermal expansion of the furnace 12, each of the support lugs 50' is attached to a base plate 62 that is able to slide on the respective horizontal main support beam 38, or on a sliding bearing 64 attached to the main support beam 38.

The support lug 50' may, in a horizontal direction, be directed to a corner of two perpendicular to each other arranged horizontal main support beams 38, whereby, the base plate 62 is advantageously supported by a sliding bearing 64 attached to the two horizontal main support beams 38. Supporting the vertical corner columns 40 from below, as shown in FIG. 5, provides the effect that there are no horizontal main support beams 38 above the vertical corner columns. In case the vertical corner column 40 is a portion of a downcomer pipe 44, the solution of FIG. 5 thus provides the advantage that the downcomer pipe 44 can be more freely extended upwards, without a need to make extra bendings around horizontal main support beams 38.

Figure 6:
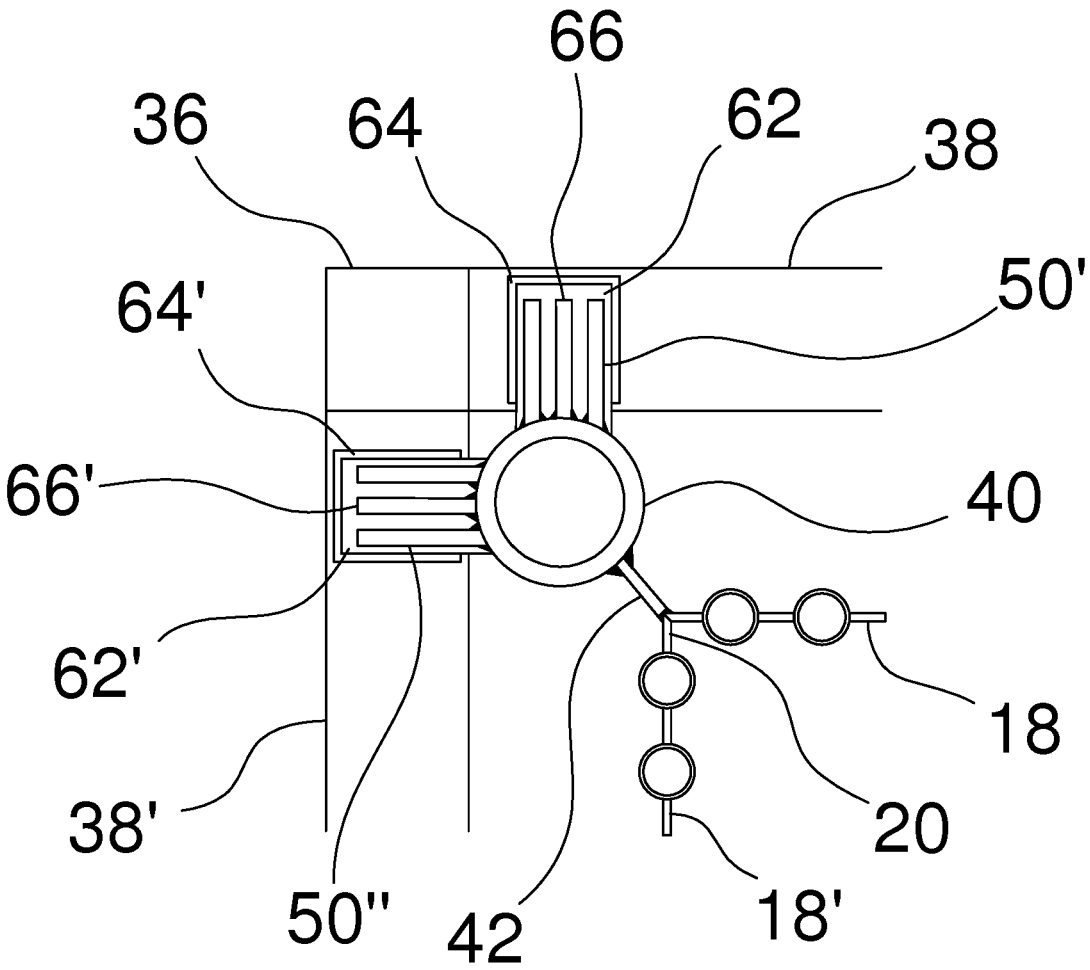
FIG. 6 schematically illustrates a detail of a boiler according to another preferred embodiment of the present invention.

According to an advantageous embodiment, schematically shown in FIG. 6, each of the support lugs 50' comprises multiple parallel ribs 66, such as three ribs, attached side by side to the vertical corner column 40 and on the base plate 62. FIG. 6 also shows another feature according to which two lugs 50', 50", or two series of ribs 66, 66', are attached at a ninety degree angle to the vertical corner column 40. The two lugs 50', 50" and their base plates 62, 62' are thereby arranged on separate sliding bearings 64, 64' arranged on two horizontal main support beams 38, 38', parallel to the tubewalls 18, 18' forming the respective corner section 20. The solution of FIG. 6 is especially advantageous when there is a need to extend a vertical main support column 36 in the crossing of the horizontal main support beams 38, 38' to a higher level than that of the horizontal support beams 38, 38'.

As becomes clear from the discussion above, different embodiments of a furnace of a fluidized bed boiler with a simple and reliable supporting construction are provided. It should be understood that the elements described in connection with an embodiment can also be used in other embodiments, when possible. Corresponding supporting constructions are also applicable in a number of other applications, such as a furnace of other type of a power boiler, a convection cage, an empty pass, a solids separator, or a horizontal pass in connection with a power boiler.

While the invention has been described herein by way of examples in connection with what are at present considered to be the most preferred embodiments, it is to be understood that the invention is not limited to the disclosed embodiments, but is intended to cover various combinations or modifications of its features and several other applications included within the scope of the invention as defined in the appended claims.

The invention claimed is:

1. A boiler construction comprising:

a boiler pressure body having a bottom and a roof at a height H from the bottom;

at least four planar watertube walls forming a polygonal horizontal cross section having at least four corner sections;

a rigid support steel structure, the boiler pressure body being supported to the rigid support steel structure at a height between the bottom and the roof of the boiler pressure body; and a corresponding vertical corner column attached exteriorly to at least four of the at least four corner sections at a height region between the bottom and roof of the boiler pressure body, wherein vertical loads of the boiler pressure body are balanced solely by the corresponding vertical corner columns by supporting each of the vertical corner columns to the rigid support steel structure at a height from 0.1 H to 0.9 H from the bottom of the boiler pressure body.

2. The boiler construction according to claim 1, wherein each of the vertical corner columns is supported to the rigid support steel structure at a height from 0.4 H to 0.6 H from the bottom of the boiler pressure body.

3. The boiler construction according to claim 1, wherein at least one of the vertical corner columns is a downcomer pipe of the boiler.

4. The boiler construction according to claim 1, wherein the vertical corner columns are arranged inside a common thermal insulation with the boiler pressure body.

5. The boiler construction according to claim 1, wherein the boiler pressure body is a furnace of a fluidized bed boiler.

6. The boiler construction according to claim 1, wherein the rigid support steel structure comprises multiple vertical main support columns supported to the ground and multiple horizontal main support beams attached to the vertical main support columns at a height from 0.1 H to 0.9 H from the bottom of the boiler pressure body.

7. The boiler construction according to claim 6, wherein each of the vertical corner columns is supported to at least one of the horizontal main support beams.

8. The boiler construction according to claim 6, wherein each of the vertical corner columns is supported to at least one of the horizontal main support beams by at least one hanger rod attached to the vertical corner column by a support lug.

9. The boiler construction according to claim 6, wherein each of the vertical corner columns is supported to at least one of the horizontal main support beams by a sliding connection.

10. The boiler construction according to claim 9, wherein the sliding connection comprises a base plate attached to the vertical corner column by vertically extending ribs and a sliding bearing.

11. The boiler construction according to claim 10, wherein each of the vertical corner columns is supported by a sliding connection to two adjacent horizontal main support beams.

12. The boiler construction according to claim 1, wherein each of the vertical corner columns is attached to the respective corner section in a height region having a height of at least 5% of the height H of the boiler pressure body.

13. The boiler construction according to claim 12, wherein each of the vertical corner columns is attached to the respective corner section in a height region having a height of at least 15% of the height H of the boiler pressure body.

14. The boiler construction according to claim 1, wherein each of the vertical corner columns is attached to the respective corner section by at least one continuous metal strip so as to provide a rigid joint in a vertical direction.

15. The boiler construction according to claim 14, wherein each of the vertical corner columns is attached to the respective corner section by continuous welding of each of the at least one continuous metal strip to an outermost water tube or to a corner fin between outermost water tubes of the water tube walls forming the corner section.

* * * * *